United States Patent [19]

Pomeroy et al.

[11] Patent Number: 4,861,301

[45] Date of Patent: Aug. 29, 1989

[54] PERSONAL FLOTATION SYSTEM

[76] Inventors: Jimmy R. Pomeroy; Ruth N. Warwick, both of 1339 Wald Rd., New Braunfels, Tex. 78130

[21] Appl. No.: 142,429

[22] Filed: Jan. 11, 1988

[51] Int. Cl.[4] ..... B63C 9/04

[52] U.S. Cl. ..... 441/131; 441/129; 220/404; 220/412; 220/375; 220/32.3

[58] Field of Search ..... 441/129, 130, 131, 132, 441/35, 40, 42; 114/343, 346, 345, 364, 267; 220/307, 314, 315, 352, 353, 356, 400, 401, 403, 404, 411, 412, 413, 241, 249, 355, 375, 902, 903, 323, DIG. 14, DIG. 7, 408, 356, 66, 67, 69, 70, 70.1, 73, 74, 232, 18; 137/70, 71, 76, 77, 78, 79

[56] References Cited

U.S. PATENT DOCUMENTS

| | | | |
|---|---|---|---|
| 3,396,885 | 8/1968 | Gionni | 220/401 |
| 3,734,336 | 5/1973 | Rankow | 220/400 |
| 3,748,672 | 7/1973 | Patrick | 441/131 |
| 4,018,371 | 4/1977 | George | 220/23.2 |
| 4,101,996 | 7/1978 | Mikulecky | 441/131 |
| 4,130,103 | 12/1978 | Zimmerman | 220/401 |
| 4,643,380 | 2/1987 | Copeland | 220/404 |
| 4,660,594 | 4/1987 | Gocze | 220/404 |

*Primary Examiner*—Sherman D. Basinger
*Assistant Examiner*—Clifford T. Bartz
*Attorney, Agent, or Firm*—Kenneth H. Johnson

[57] ABSTRACT a haversack adapted to securely hold an ice chest and having a strap means to releasably attach the haversack to a toroid flotation device, e.g., an automobile inner tube, preferably on the exterior of the tube.

11 Claims, 2 Drawing Sheets

PERSONAL FLOTATION SYSTEM

BACKGROUND OF THE INVENTION

The use of inflated automobile tire inner tubes as flotation support in water has been popular for many years. The large inner tubes for truck tires have been especially popular because they permit a person to sit "inside" the inner tube while allowing the person to dangle his legs over the tube. This type of flotation is especially popular in relatively calm waters such as lakes, but has become increasingly popular in mild white water conditions and mild surf.

The use of these flotation devices has spawned several devices which allow a bather to have refreshments nearby or provide a storage place for valuables. One such device is disclosed in U.S. Pat. No. 3,367,525 which is a floating tray. While this may be satisfactory in calm water, it might become separated from the bather in mild white water conditions. Other means for carrying refreshments include tying a floor to the inner tube making it in effect, a circular raft. The last has the disadvantage of spilling all the contents when tipped over.

Additionally, styrene ice chests have become very popular over the last few years due to their low cost and light weight. These ice chests may now be purchased in many sizes and shapes from almost any retail outlet which sells ice or cold drinks.

Finally knapsacks and haversacks have been used for many years to carry effects on a person's back. These normally have two straps that fit over the shoulders or one drawstring to toss the bag over the shoulder. Large duffel bags have a single strap used to close the top and to sling over the shoulder.

SUMMARY OF THE INVENTION

In order to provide a personal flotation system with convenient storage, the present invention includes a toroid flotation means in the form of an inflated inner tube and a styrene ice chest enclosed in a haversack secured to the inner tube. The haversack is conveniently provided with a first single strap secured along a tubular body which is long enough to reach through and around the inner tube toroid. The bottom of the body is partially closed, for example, by a drawstring to provide support for the ice chest. A second strap is secured across the top of the body to hold the ice chest within the haversack. The two ends of the first strap are secured together preferably by nylon hook and loop tape such as Velcro ® as is the free end of the second strap to the body. A zippered pocket may be provided on the top of the second strap to contain valuables such as keys or small change.

DETAILED DESCRIPTION OF THE PREFERRED EMBODIMENT

Referring now to the figures in which like components are indicated by like numbers, the details of the present invention are shown.

Figure 1:
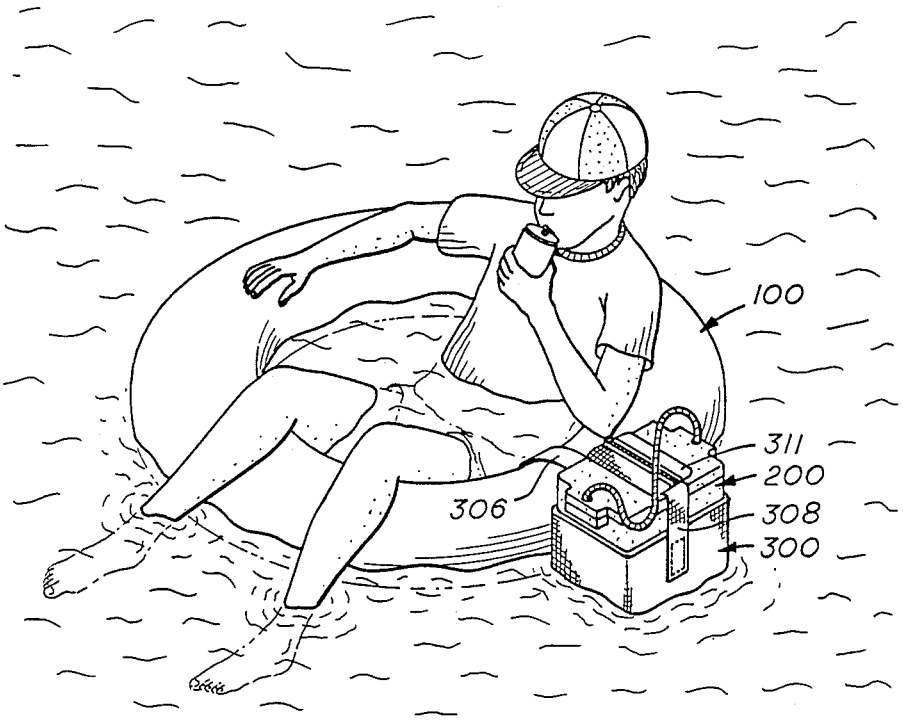
FIG. 1 is a perspective view of the present invention in use by a bather.

FIG. 1 is an overall view of the present invention in use by a bather. A toroid flotation device is provided in the form of an inflated inner tube 100. An ice chest 200 is contained within a haversack 300 which is secured to the inner tube by a single strap 306. A second strap 308 secures the ice chest 200 within the haversack 300. A zippered pocket 311 is provided on top of second strap 308 to carry small valuables such as keys or coins.

Figure 2:
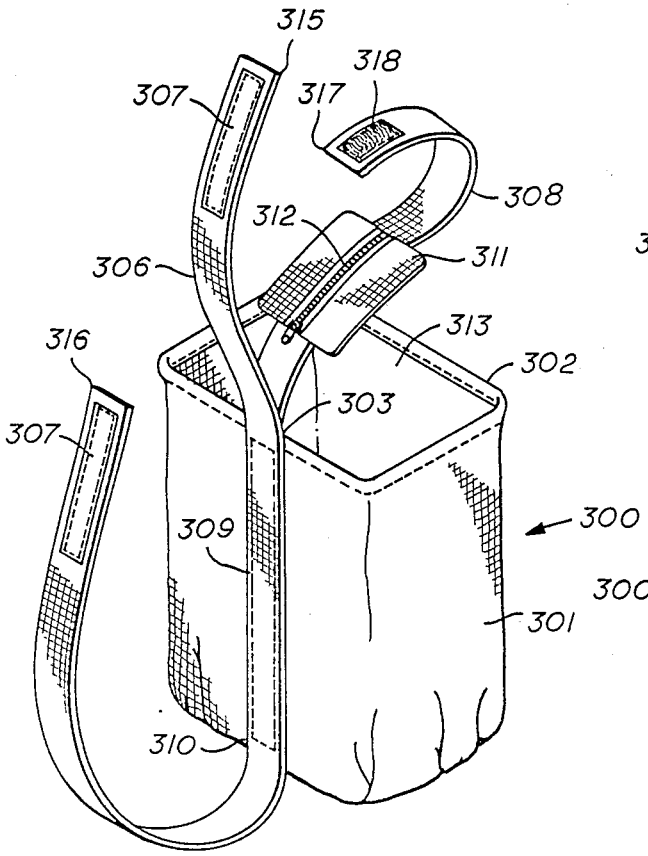
FIG. 2 is a top perspective view of one embodiment of the haversack as used in the present invention.
Figure 3:
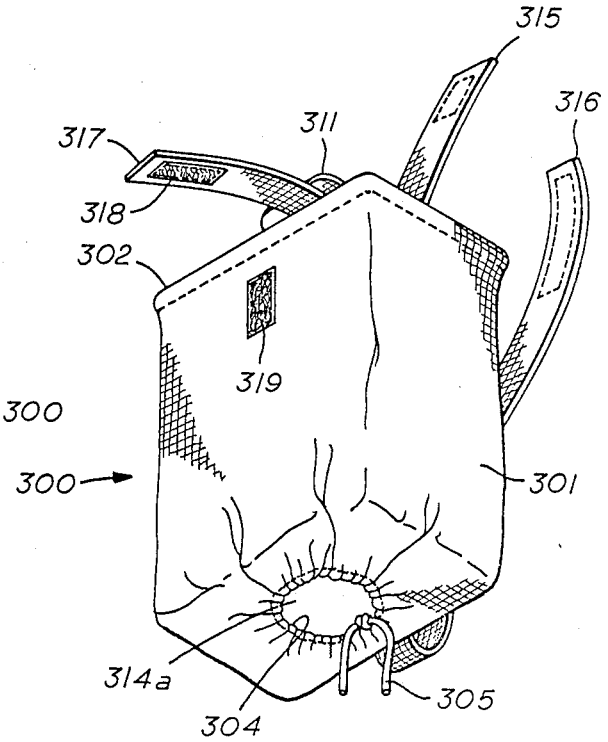
FIG. 3 is a bottom perspective view of the embodiment of the haversack shown in FIG. 1 showing one bottom closure means.
Figure 4:
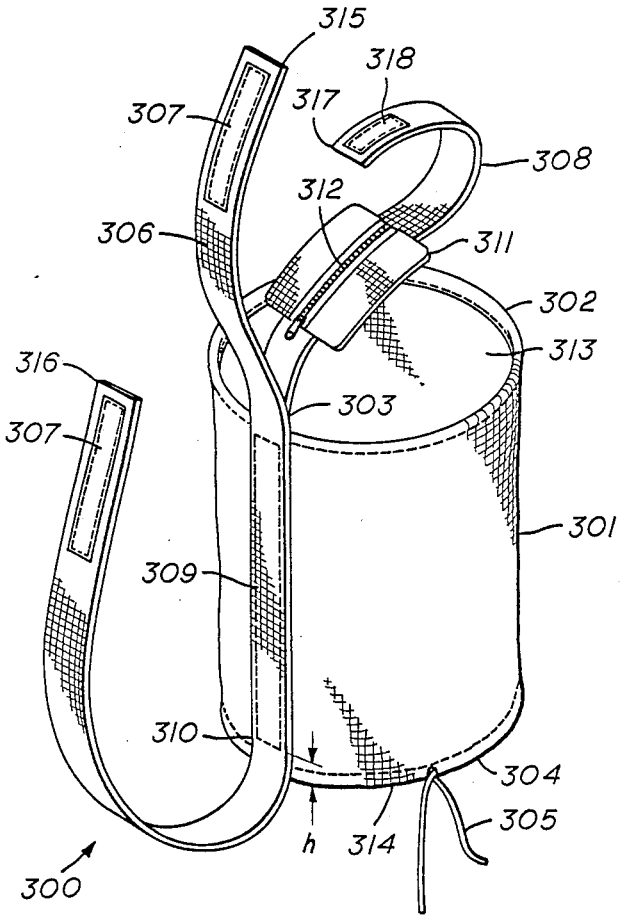
FIG. 4 is a perspective view of the embodiment of FIG. 1 showing the bottom open.

Referring now to FIGS. 2–6 details of the haversack are shown. Referring first to FIG. 4 the haversack 300 is shown to have a substantially tubular body 301 of cloth or the like, having an upper margin 302 defining an upper opening 313 and a lower margin 304 defining a lower opening 314. A drawstring 305 is provided in the lower margin 304 to partially close the lower opening 314 as shown in FIG. 3. The closing provides support for the ice chest (not shown) in the haversack. The partially closed lower opening **314*a*** allows any water entering the haversack to flow out when lifted.

The haversack 300 is provided with a first strap 306 longitudinally sewn on the body 301 by stitching 309. While the stitching 309 may secure the strap at the upper margin 302, the bottom stitching 310 should be some distance h away from the bottom margin 304 to allow the gathering of the lower margin as shown in FIG. 3. The drawstring would still work, without h, but the distance h makes it work more easily. The first strap 306, as noted, is secured intermediate to the ends 315 and 316 which extend out away from the body 301 a sufficient length to surround a toroid body through its central hole. Each end 315 and 316 is provided with nylon hook and loop take 307, such as Velcro ®, on the appropriate opposite surfaces to releasably secure the ends together. It should be noted that a buckle or snap arrangement (not shown), which though not as convenient, would provide a satisfactory releasable connection.

The haversack 300 is also provided with a second strap 308 connected to the tubular body 301 by an attachment end 303. The second strap could be secured to the tubular body underneath the first strap 306 using the same stitching 309. The free end 307 of the second strap 308 extends across the upper opening 313 and is releasably connected to the body 301 most conveniently with nylon hook and loop tape 318 on the strap and the same at 319 on the body. Again a buckle arrangement would be satisfactory.

A deformable stiffener (not shown) may be placed inside the upper margin 302 which can be conformed to the shape of the ice chest as shown in FIGS. 2 and 3. The body 301 is in the form of a tube for ease of manufacture, only one seam being required.

Figure 5:
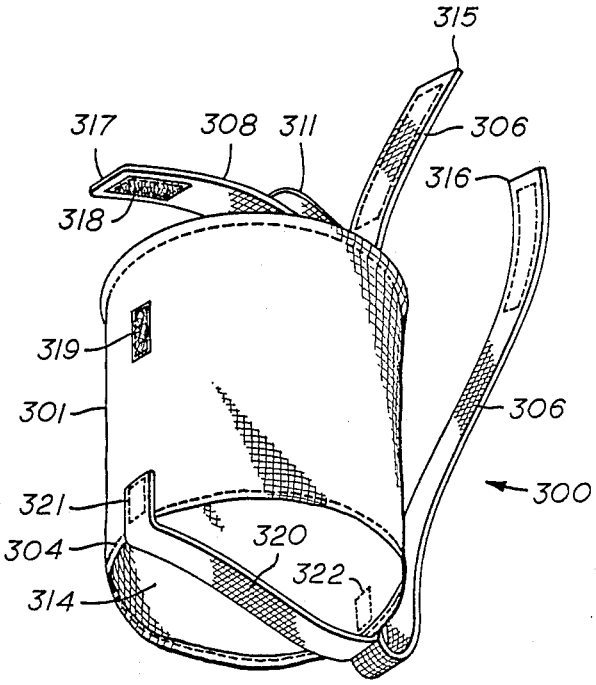
FIG. 5 is a bottom perspective view of the haversack showing alternative support means on the bottom.
Figure 6:
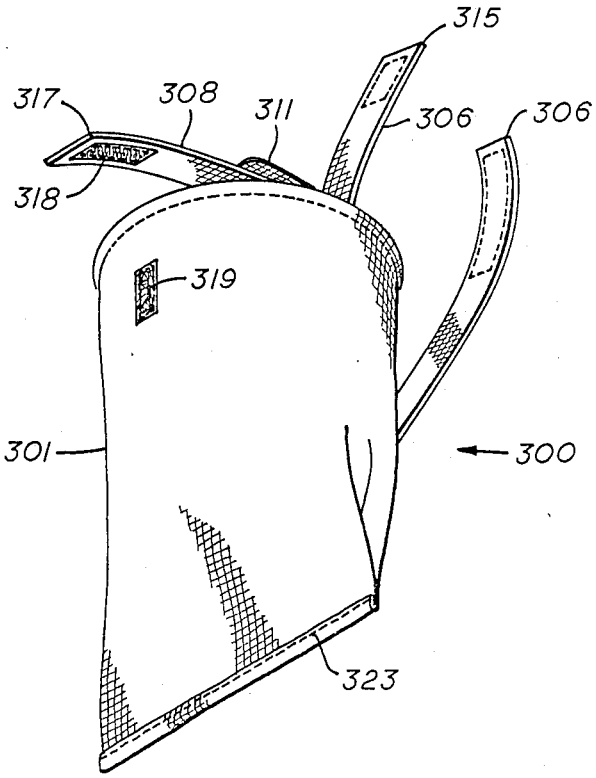
FIG. 6 is a bottom perspective view of the haversack showing yet another closure means for the bottom.

FIGS. 5 and 6 depict alternate support arrangements at the lower margin 304. FIG. 5 depicts a single strap 320 connected to the body 301 at either end 321 and 322 and extending across lower opening 314. In FIG. 6 the lower opening is shown sewn together with stitching 323.

In all the embodiments shown a pocket 311 is attached to second strap 306. The pocket 311 is provided with a zipper 312 for easy opening and closing. The pocket is useful for carrying small items, particularly keys, wallets and coins.

Figure 7:
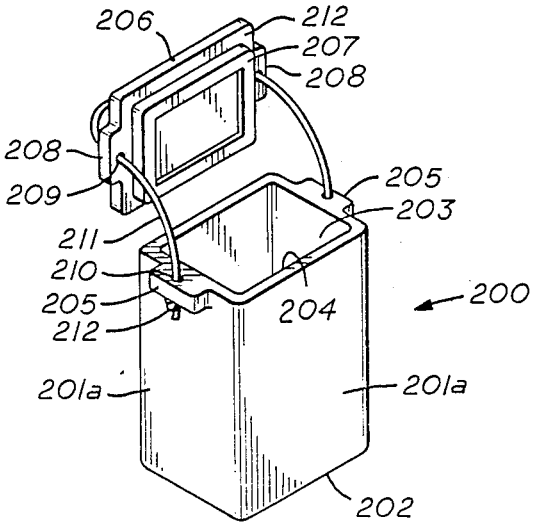
FIG. 7 is a perspective view of a typical styrene ice chest used in the invention.

Finally, FIG. 7 depicts a typical inexpensive ice chest 200 which may be used with the haversack 300 on the flotation collar 100. The ice chest as shown has a generally rectangular body 201 formed in a single piece of foamed polystyrene which has four sides 201*a* and a bottom 202 which define a cavity 203 with an opening 204 at the top. The body includes two flanges 205 on opposite sides at the top, the flanges 205 having vertical holes 210 therethrough.

A lid 206, also of a single piece of foamed polystyrene, is provided having the same shape as the top of the body 201. The lid 206 has flanges 208 which match the body flanges 205. The lid flanges 208 also include vertical holes 209. On the underside 212, the lid 206 is provided with a downwardly projecting lip 207, the outer dimensions of which is substantially the same as the opening 204 in the top of the body 201. When pressed down, the lid 206 is in sealing engagement with the inner surface of sides 201*a* due to the lip 207.

The lid 206 is loosely secured to the body 201 by means of a cord 211 which is secured on the underside of the body flanges 205, as by a large knot 212, and which is passed through holes 210 and 209 in flanges 205 and 208. Although not visible, there is a knot 212 under both body flanges 205. The length of the cord 211 is sufficient to allow the lid 206 to be lifted from the body 201, its purpose simply being to prevent the lid 206 and body 201 from becoming separate. The lid 206 is normally held in place on the body 201 by the friction fit between the lip 207 and the inner surfaces of the side 201*a*.

Since foamed polystyrene ice chests come in many different shapes and the haversack body 301 is deformable, the shape of the ice chest should not be limited. Also, the material of construction of the ice chest could be varied. Many such variations could be made which fall within the scope of the appended claims.

The invention claimed is:

1. A personal flotation system comprising in combination:

(a) flotation means for supporting a person in the water;

(b) a haversack secured to said flotation means; said haversack comprising:

(i) a substantially tubular pliant cloth body having an upper margin and a lower margin, said margins defining upper and lower openings respectively;

(ii) a first strap attached to said body to releasably secure said body to said flotation means in a substantially upright position;

(iii) a closure means for substantially closing said lower opening to support said ice chest within said body; and (iv) a second strap attached to said upper margin and extending across said upper opening to releasably secure said ice chest within said body; and (c) an ice chest secured within said haversack; said ice chest comprising:

(i) a substantially rectangular body formed of lightweight insulation material, said rectangular body having four sides and a bottom defining a cavity having an opening at the top;

(ii) first flanges on opposite sides of said rectangular body at the top, said first flanges defining vertical holes therethrough;

(iii) a rectangular lid of the same material as said body and of substantially the same dimension as said top, said lid having a top side and a bottom side;

(iv) a downwardly projecting lip about the margin of said lid on said bottom side, the outer dimension of said lip being substantially the same as said opening, such that said lip provides a seal between said lid and said body;

(v) second flanges on opposite sides of said lid, said second flanges defining vertical holes therethrough, said first and second flanges mating such that said vertical holes align; and (vi) a cord secured on the underside of said first flanges and passing through said vertical holes and over said lid to secure said lid to said body.

2. The flotation system of claim 1 wherein said flotation means comprises a toroid flotation collar such as a large inflated automobile tire inner tube.

3. The personal flotation system according to claim 2 wherein said haversack is secured by a releasable strap means about said toroid.

4. The personal flotation system according to claim 3 wherein said haversack is attached to the outer circumference of said toroid.

5. A combination haversack and chest for use with a toroid flotation collar such as an inflated automobile tire inner tube, comprising:

(a) a substantially rectangular chest and lid, said lid being secured to said chest by means of a cord passed through matching holes in flanges on either side of said ice chest and said lid; and (b) a haversack enclosing said chest, said haversack including;

(i) a substantially tubular body having an upper margin and a lower margin defining upper and lower openings respectively, said body conforming to the shape of said chest;

(ii) a support means at said lower margin to support said chest within said tubular body;

(iii) a first strap for securing said body to a flotation collar in a substantially upright position;

(iv) a second strap across said top opening to releasably secure said chest within said tubular body; and (v) a closable pocket attached to said second strap.

6. A haversack useful for securing a chest to a toroid flotation collar such as an inflated automobile tire inner tube, comprising:

(a) a substantially tubular body having upper and lower margins defining upper and lower openings respectively;

(b) a support means at said lower margin to support a chest in said tubular body;

(c) a first strap longitudinally secured to said body, the ends of said strap extending from said upper margin and from near said lower margin for a distance sufficient to surround a toroid flotation collar;

(d) a first releasable securing means on the ends of said first strap for releasably securing said ends together;

(e) a second strap secured by an attachment end to said top margin, the length of said second strap being sufficient to extend across said top opening;

(f) a second releasable securing means for releasably securing the free end of said second strap to said body opposite said attachment end; and (g) a closable pocket attached to said second strap.

7. The haversack of claim 6 wherein said support means comprises a drawstring secured within said lower margin.

8. The haversack of claim 6 wherein said support means comprises at least one strap stretching across said bottom opening and securely attached at each end to said lower margin.

9. The haversack of claim 6 wherein said support means comprises stitching that completely closes said bottom opening.

10. The haversack of claim 6 further comprising a deformable stiffening means secured in said upper margin.

11. The combination of claim 5 wherein said haversack further comprises a deformable stiffening means secured in said upper margin, said stiffening means substantially in the shape of said chest.

* * * * *